US010807156B2

(12) United States Patent
Ehara et al.

(10) Patent No.: US 10,807,156 B2
(45) Date of Patent: Oct. 20, 2020

(54) METHOD FOR PRODUCING AUSTENITE STAINLESS STEEL SLAB

(71) Applicant: NIPPON STEEL STAINLESS STEEL CORPORATION, Tokyo (JP)

(72) Inventors: Yasuhiro Ehara, Tokyo (JP); Shun Saito, Tokyo (JP); Kazunari Morita, Tokyo (JP); Hiroshi Morikawa, Yamaguchi (JP)

(73) Assignee: NIPPON STEEL STAINLESS STEEL CORPORATION, Tokyo (JP)

( * ) Notice: Subject to any disclaimer, the term of this patent is extended or adjusted under 35 U.S.C. 154(b) by 0 days.

(21) Appl. No.: 16/493,851

(22) PCT Filed: Mar. 14, 2018

(86) PCT No.: PCT/JP2018/009989
§ 371 (c)(1),
(2) Date: Sep. 13, 2019

(87) PCT Pub. No.: WO2018/173888
PCT Pub. Date: Sep. 27, 2018

(65) Prior Publication Data

US 2020/0030873 A1 Jan. 30, 2020

(30) Foreign Application Priority Data

Mar. 24, 2017 (JP) ..... 2017-060176

(51) Int. Cl.
*B22D 11/115* (2006.01)
*C22C 38/00* (2006.01)
(Continued)

(52) U.S. Cl.
CPC ..... *B22D 11/115* (2013.01); *C21D 9/0081* (2013.01); *C22C 38/001* (2013.01);
(Continued)

(58) Field of Classification Search
CPC ..... B22D 11/049; B22D 11/115
(Continued)

(56) References Cited

U.S. PATENT DOCUMENTS 4,527,615 A * 7/1985 Narita ..... B22D 11/115 164/440
5,697,425 A * 12/1997 Nanba ..... B22D 11/00 164/468
5,722,480 A * 3/1998 Asai ..... B22D 11/115 164/466

FOREIGN PATENT DOCUMENTS

JP 06-190507 7/1994
JP 10-166120 6/1998
(Continued)

*Primary Examiner* — Kevin E Yoon
(74) *Attorney, Agent, or Firm* — Clark & Broady LP

(57) ABSTRACT

A method for producing an austenitic stainless steel slab by continuous casting of an austenitic stainless steel, including applying electric power to the molten steel in a depth region providing a solidification shell thickness of from 5 to 10 mm at least at a center position in the long edge direction, so as to cause flows in directions inverse to each other in the long edge direction on both long edge sides, thereby performing electro-magnetic stirring (EMS) to control a continuous casting condition satisfying $10<\Delta T<50\times F_{EMS}+10$. Herein, $\Delta T$ represents a difference between an average molten steel temperature (° C.) and a solidification starting temperature (° C.) of the molten steel, and $F_{EMS}$ represents a stirring intensity index shown by a function of a molten steel flow velocity in the long edge direction imparted by the electro-magnetic stirring and a casting velocity.

5 Claims, 4 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/16*** | (2006.01) |
| ***C22C 38/32*** | (2006.01) |
| ***C21D 9/00*** | (2006.01) |
| ***C22C 38/08*** | (2006.01) |

(52) U.S. Cl.
CPC ..... *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/32* (2013.01); *C21D 2211/001* (2013.01)

(58) Field of Classification Search
USPC ..... 164/468
See application file for complete search history.

(56) References Cited

FOREIGN PATENT DOCUMENTS

| | | | |
|---|---|---|---|
| JP | 2000271711 A | * | 10/2000 |
| JP | 2004-098082 | | 4/2004 |
| JP | 2005-297001 | | 10/2005 |
| JP | 2010-024522 | | 2/2010 |
| JP | 2010-052026 | | 3/2010 |
| JP | 2015/147216 | | 10/2015 |
| JP | 2017-024078 | | 2/2017 |

* cited by examiner

[Fig.1]
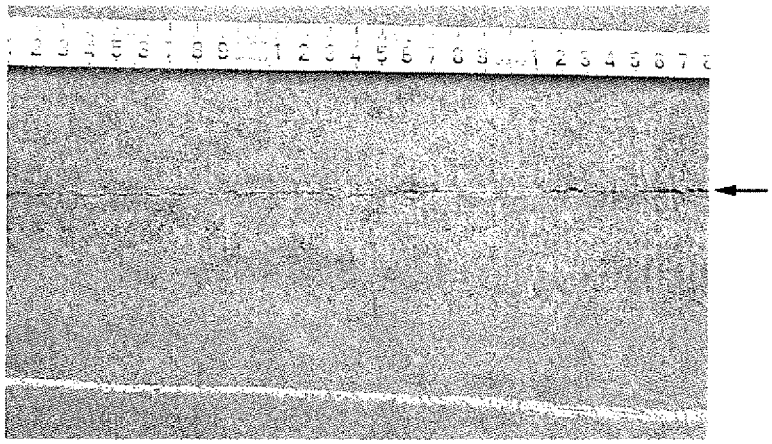
[Fig.2]
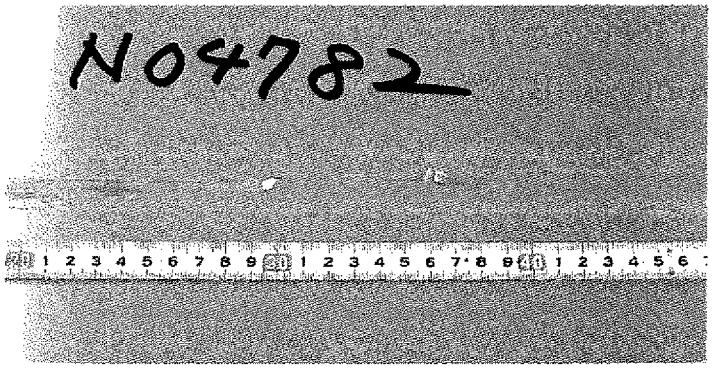
[Fig.3]
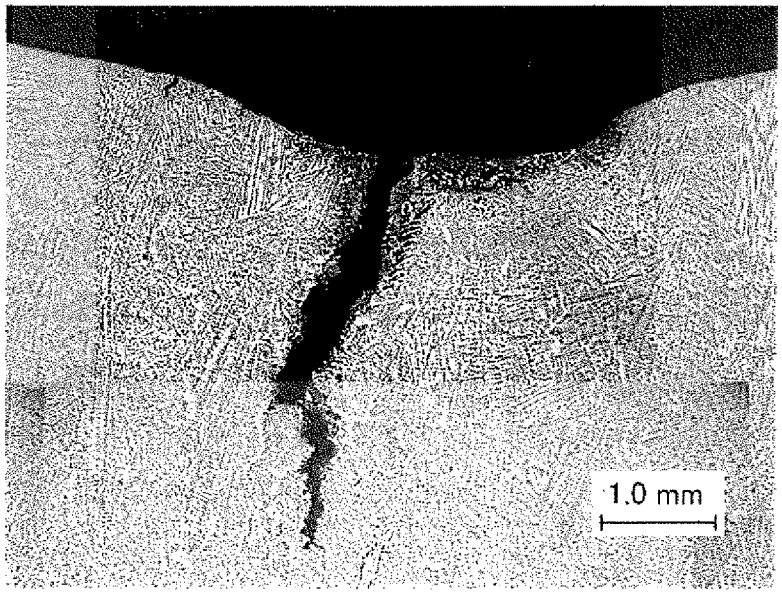

[Fig.4]
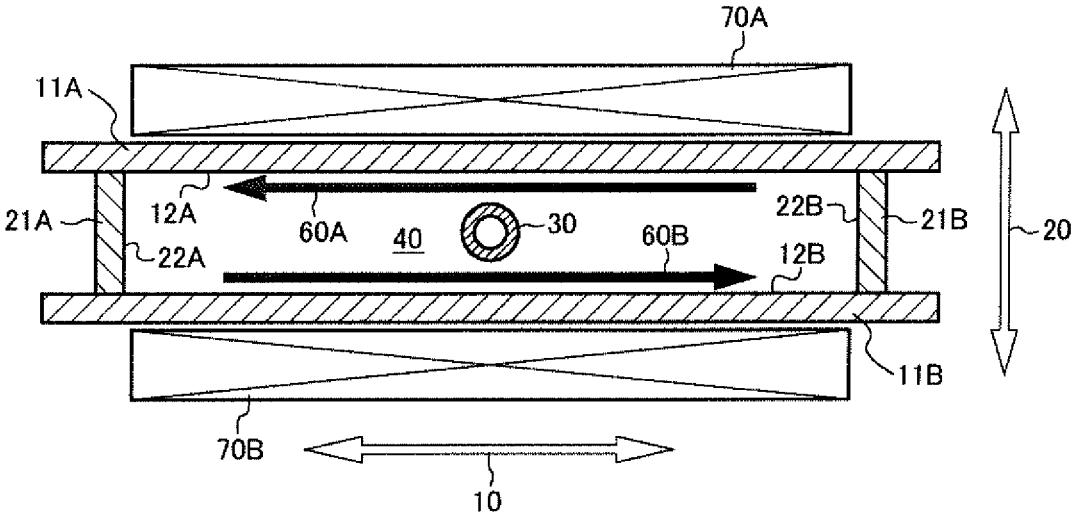
[Fig.5]
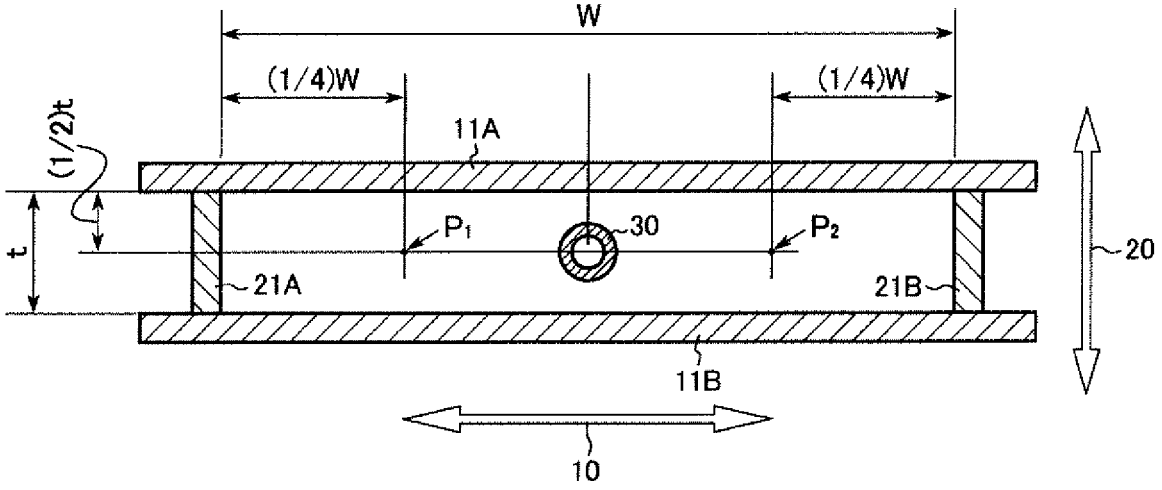

[Fig.6]
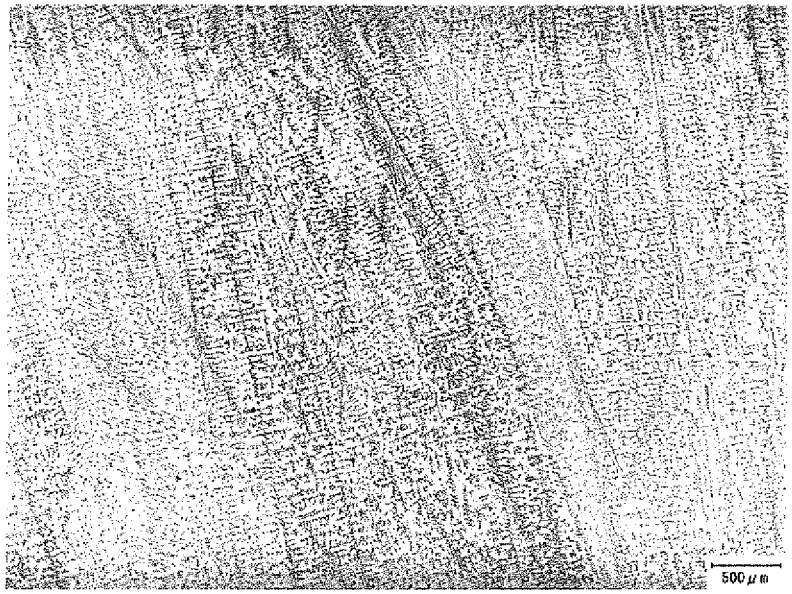
[Fig.7]
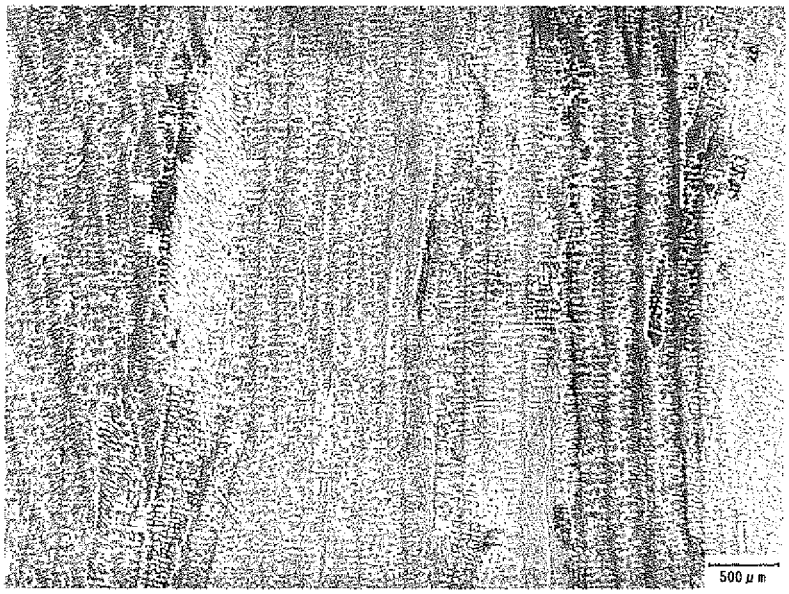

[Fig.8]
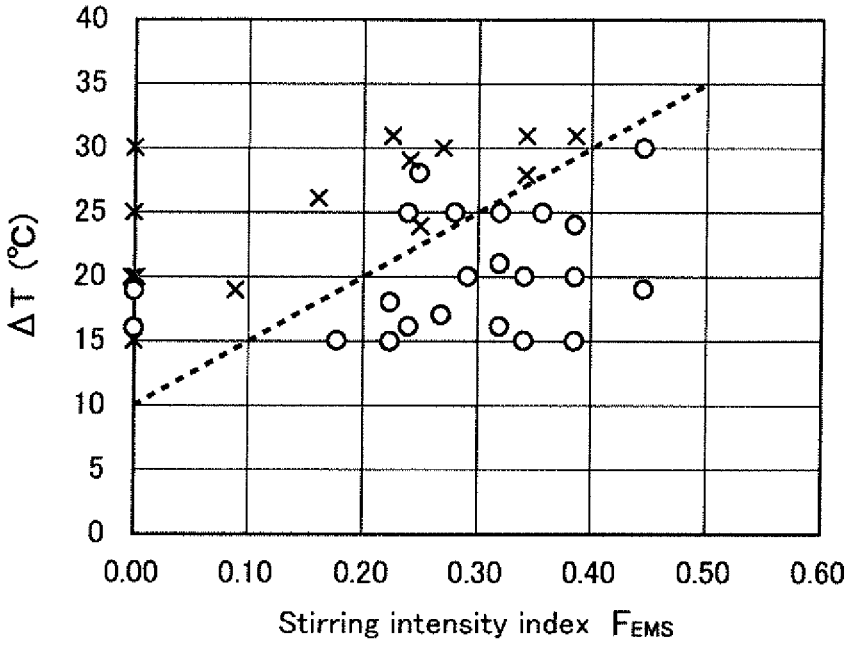

METHOD FOR PRODUCING AUSTENITE STAINLESS STEEL SLAB

TECHNICAL FIELD

The present invention relates to a method for producing an austenitic stainless steel slab by continuous casting utilizing electro-magnetic stirrer (EMS).

BACKGROUND ART

The continuous casting method has been widely utilized as a manufacturing method of an austenitic stainless steel, such as SUS 304. The resulting continuously cast slab can be formed into a thin steel strip through processes including hot rolling and cold rolling. The production technique thereof has been established in these days, and a thin steel strip of an austenitic stainless steel is being used as product materials in many applications. However, the thin steel strip of an austenitic stainless steel may even undergo an explicit surface flaw in some cases, which is considered to be derived from a surface defect of the cast slab. The problem of a surface flaw of the thin steel strip may be avoided in most cases by introducing a process of grinding the surface of the slab with a grinder. However, the surface grinding with a grinder may increase the cost. Such a production technique of the continuously cast slab is demanded that causes no problem of a surface flaw on a thin steel strip even though the surface grinding is omitted.

PTL 1 describes a technique of relieving a surface defect derived from an oscillation mark in a continuously cast slab of an austenitic stainless steel. In the continuous casting of a steel, electro-magnetic stirrer (EMS) is effective as a measure for suppressing contamination of the solidification shell with foreign matters, and has been widely utilized (see, for example, PTL 2). PTL 3 describes an example, in which electro-magnetic stirring is performed, and the discharge angle from the submerged nozzle is set to 5° upward, thereby relieving a bubble defect and a crack occurring in a continuously cast slab of a medium carbon steel and a low carbon steel. However, even in the case where these techniques are applied to an austenitic stainless steel, it is difficult to relieve stably and significantly the occurrence of a surface flaw in a thin steel strip thereof derived from the cast slab.

CITATION LIST

Patent Literatures

PTL 1: JP 6-190507 A
PTL 2: JP 2004-98082 A
PTL 3: JP 10-166120 A
PTL 4: JP 2005-297001 A
PTL 5: JP 2017-24078 A

SUMMARY OF INVENTION

Technical Problem

According to the investigations by the present inventors, it has been confirmed that the surface flaw, which is explicit in a thin steel strip of an austenitic stainless steel and tends to be a problem particularly in a purpose requiring a goods surface appearance, is derived mainly from a surface defect involving a crack formed in the longitudinal direction (i.e., the casting direction) of the continuously cast slab. In the following description, the defect of this type on the surface of the slab is referred to as a "surface defect in casting direction". The occurrence of a surface flaw on a thin steel strip derived from the surface defect in casting direction cannot be avoided even though the oscillation mark is smoothened as described in PTL 1.

According to the researches by the inventors, it is considered that the surface defect in casting direction of the continuously cast slab is formed through the following mechanism.

In the case where the cooling in the mold in the continuous casting process unevenly occurs, the thickness of the solidification shell becomes uneven, and then the stress caused by the solidification contraction and the ferrostatic pressure is concentrated thereto to form a fine crack. The crack appears as the surface defect in casting direction on the surface of the slab. The crack does not grow to such a depth that breaks the solidification shell having been formed, and thus does not bring about a serious situation inhibiting the operation of the continuous casting.

While the cause of the aforementioned local decrease of the cooling rate cannot be necessarily identified, it is considered that such a phenomenon occurs that the solidification shell is locally detached from the mold in the initial stage of solidification since the observation of the portion having the surface defect in the casting direction reveals that a depression frequently occurs therein. Plural causes may be considered therefor, such as uneven inflow of the mold powder and uneven deformation of the solidification shell caused by the solidification contraction. The surface defect in casting direction of this type tends to be a problem particularly in an austenitic stainless steel species, as compared to a ferritic stainless steel species and the like, and this is considered to be caused by the difference in solidification mode.

It has been known that the unevenness in cooling in the mold is promoted by the forced cooling condition, and a measure has been proposed for suppressing the occurrence of the surface defect in casting direction on the surface of the slab by gradual cooling in the mold. For example, PTL 4 proposes that the solidification shell is gradually cooled by increasing the heat resistance of the mold powder layer with the use of mold powder that is readily crystallized. However, the effect of the gradual cooling cannot be said to be sufficient only with the mold powder, and the surface defect in casting direction on the surface of the austenitic stainless steel slab cannot be completely avoided. Furthermore, the replacement of the mold powder may influence the other quality factors, such as the depth of the oscillation mark, and the occurrence of the breakout, and thus cannot be easily employed. PTL 5 achieves the gradual cooling of the mold by filling a metal having a low thermal conductivity on the inner wall of the mold. However, the surface defect in casting direction on the surface of the slab cannot be completely prevented only by the measure. Furthermore, in the case where the mold of this type is applied, the mold cannot be applied only to the steel species having the problem of the surface defect in casting direction, but is necessarily applied to all the other steel species, and therefore another factor deteriorating the surface quality may occur in the other steel species.

An object of the invention is to disclose a continuous casting technique for an austenitic stainless steel that significantly suppresses the "surface defect in casting direction" occurring in the longitudinal direction (i.e., the casting direction) of the continuously cast slab, and to provide a continuously cast slab of an austenitic stainless steel that significantly hardly undergoes a surface flaw after processing up to a thin steel strip even though the treatment of the surface of the continuously cast slab with a grinder is omitted.

Solution to Problem

In consideration of the circumstances, the inventors have made the earnest investigations on a method for suppressing the surface defect in casting direction on the surface of an austenitic stainless steel slab, and as a result, have found a measure for achieving homogeneous gradual cooling in the mold by combining "decrease in casting temperature" and "in-mold electro-magnetic stirring". It has been confirmed that the application of the measure can significantly suppress the surface defect in casting direction in the existing continuous casting apparatus. The invention has been achieved based on the knowledge.

The invention relates to the following.

A method for producing an austenitic stainless steel slab, assuming that in continuous casting of a steel using a mold having a rectangular profile shape of an inner surface of the mold cut in a horizontal plane, two inner wall surfaces of the mold constituting long edges of the rectangular shape each are referred to as a "long edge surface", two inner wall surfaces of the mold constituting short edges thereof each are referred to as a "short edge surface", a horizontal direction in parallel to the long edge surface is referred to as a "long edge direction", and a horizontal direction in parallel to the short edge surface is referred to as a "short edge direction", including: discharging a molten steel of an austenitic stainless steel having a chemical composition containing, in terms of percentage by mass, from 0.005 to 0.150% of C, from 0.10 to 3.00% of Si, from 0.10 to 6.50% of Mn, from 1.50 to 22.00% of Ni, from 15.00 to 26.00 of Cr, from 0 to 3.50% of Mo, from 0 to 3.50% of Cu, from 0.005 to 0.250% of N, from 0 to 0.80% of Nb, from 0 to 0.80% of Ti, from 0 to 1.00% of V, from 0 to 0.80% of Zr, from 0 to 1.500% of Al, from 0 to 0.010% of B, and from 0 to 0.060% in total of a rare earth element and Ca, with the balance of Fe and unavoidable impurities, having a value A of 20.0 or less defined by the following expression (4), from a submerged nozzle having two discharge ports disposed at a center in the long edge direction and the short edge direction in the mold; and applying electric power to the molten steel in a vicinity of a solidification shell in a depth region providing a solidification shell thickness of from 5 to 10 mm at least at a center position in the long edge direction, so as to cause flows in directions inverse to each other in the long edge direction on both long edge sides, thereby performing electro-magnetic stirring (EMS) to control a continuous casting condition satisfying the following expression (1):

$$10<\Delta T<50\times F_{EMS}+10 \quad (1)$$

wherein ΔT and $F_{EMS}$ are represented by the following expressions (2) and (3) respectively:

$$\Delta T=T_L-T_S \quad (2)$$

$$F_{EMS}=V_{EMS}\times(0.18\times V_C+0.71) \quad (3)$$

wherein $T_L$ represents an average molten steel temperature (° C.) at an average molten steel surface depth of 20 mm at a position of a ¼ position in the long edge direction and a ½ position in the short edge direction; $T_S$ represents a solidification starting temperature (° C) of the molten steel; $F_{EMS}$ represents a stirring intensity index; $V_{EMS}$ represents an average molten steel flow velocity (m/s) in the long edge direction imparted by the electro-magnetic stirring in a depth region providing a solidification shell thickness of from 5 to 10 mm at a center position in the long edge direction; and $V_C$ represents a casting velocity (m/min) corresponding to a progress velocity of the cast slab in a longitudinal direction:

$$A=3.647(Cr+Mo+1.5Si+0.5Nb)-2.603(Ni+30C+30N+0.5Mn)-32.377 \quad (4)$$

wherein the element symbols in the expression (4) represent contents of the elements in terms of percentage by mass respectively.

In the continuous casting, the continuous casting condition is preferably controlled to further satisfy also the following expression (5). The following expression (6) may be employed instead of the expression (5).

$$\Delta T\leq 25 \quad (5)$$

$$\Delta T\leq 20 \quad (6)$$

The continuous casting condition is preferably controlled to further satisfy also the following expression (7). The following expression (8) may be employed instead of the expression (7).

$$F_{EMS}\leq 0.50 \quad (7)$$

$$F_{EMS}\leq 0.40 \quad (8)$$

The surface of the molten steel in the mold fluctuates by the flow and vibration of the molten metal during the operation of the continuous casting. The "average molten steel surface depth" is the depth in the vertically downward direction based on the average position of the surface of the molten steel. There are two positions for the "positions at a ¼ position in the long edge direction and a ½ position in the short edge direction" with the center submerged nozzle intervening therebetween in the mold. The average molten steel temperature $T_L$ (° C.) is the average value of the molten steel temperatures at an average molten steel surface depth of 20 mm at the two positions. The solidification starting temperature $T_S$ (° C.) is a temperature corresponding to the liquidus line temperature.

Advantageous Effects of Invention

According to the method for producing a continuously cast slab of the invention, in a continuously cast slab of an austenitic stainless steel, the occurrence of the "surface defect in casting direction" can be significantly suppressed, and the problem of a surface flaw derived from the slab appearing on the thin steel strip of an austenitic stainless steel can be avoided by a production process, in which the treatment of the surface of the continuously cast slab with a grinder is omitted.

BRIEF DESCRIPTION OF DRAWINGS

FIG. 1 is an appearance photograph of a continuously cast slab of an austenitic stainless steel having a surface defect in casting direction occurring thereon.

FIG. 2 is an appearance photograph of a cold rolled steel sheet of an austenitic stainless steel having a surface flaw derived from a surface defect in casting direction of a slab.

FIG. 3 is a photograph of a cross sectional structure near the surface of a continuously cast slab of an austenitic stainless steel having a surface defect in casting direction occurring thereon.

FIG. 4 is a cross sectional view schematically exemplifying a cross sectional structure of a continuous casting apparatus capable of being applied to the invention, cut in the horizontal plane at the surface of the molten steel in the mold.

FIG. 5 is an illustration showing the "positions at a ¼ position in the long edge direction and a ½ position in the short edge direction" by symbols $P_1$ and $P_2$ in the mold shown in FIG. 4.

FIG. 6 is a photograph of a metal structure of a continuously cast slab of an austenitic stainless steel according to the invention obtained by a method employing electromagnetic stirrer, on the cross sectional surface perpendicular to the casting direction.

FIG. 7 is a photograph of a metal structure of a continuously cast slab of an austenitic stainless steel obtained by a method employing no electro-magnetic stirrer, on the cross sectional surface perpendicular to the casting direction.

FIG. 8 is a graph plotting the relationship between ΔT and $F_{EMS}$.

DESCRIPTION OF EMBODIMENTS

In the continuous casting, a flux layer formed of molten mold powder is generally formed on the surface of the molten steel. The flux intervenes from the surface of the molten steel into the gap between the solidification shell and the mold to form a flux film, which bears lubrication between them. In general, the distance between the solidification shell and the mold separated by the flux film is substantially homogeneous at the same positions in the casting direction (i.e., the positions with the same depth from the surface of the molten steel), and the heat removal by the mold occurs substantially homogeneously. However, there may be a position where the distance between the shell and the mold in the initial stage of solidification is increased due to some sort of factors, such as invasion of a foreign matter between the solidification shell and the mold. At that position, the solidification proceeds in such a state that the thickness of the solidification shell is smaller than the surrounding since the surface of the solidification shell is depressed from the surrounding, and the cooling rate is lowered from the surrounding. At the position where the distance is increased in viewing from the above in the casting direction, the state where the thickness of the solidification shell is smaller than the surrounding is continued for a certain period of time until the influence of the factor increasing the distance (such as the invasion of a foreign matter) is resolved. Accordingly, the solidification shell inside the mold has formed therein a region of a thin portion of the solidification shell extending in the casting direction. The stress is concentrated to the thin portion of the solidification shell, and at the time when the surface portion thereof cannot withstand the stress, a surface crack extending in the casting direction occurs inside the mold. However, the crack is minute and does not cause an accident where the molten metal leaks therefrom (i.e., breakout). It is considered that the "surface defect in casting direction" formed on the continuously cast slab of an austenitic stainless steel is formed in this mechanism.

While the major austenitic stainless steel is solidified often with a δ ferrite phase as a primary crystal, there may be a case where the proportion of the δ ferrite phase formed is considerably small and a case where the austenite single phase is solidified, depending on the chemical composition. P and S as the impurities in the steel tend to be dissolved in the δ ferrite phase rather than the austenite phase, and therefore particularly in a steel species having a small proportion of the δ ferrite phase formed, P and S tend to undergo segregation at the grain boundary of the austenite phase, and decrease the strength of that portion. It is considered consequently that the "surface defect in casting direction" involving a surface crack tends to occur in an austenitic stainless steel rather than a ferritic stainless steel.

The surface defect in casting direction involving a surface crack is often observed with a length of from several centimeters to several tens centimeters in the longitudinal direction of the slab. In the case where the extent of the surface crack formed is considerably large under visual inspection, there may be cases where the portion is intensively treated with a grinder. However, the surface crack of this kind exists in the shallow portion of the surface of the slab, and thus generally does not grow to an increased crack through hot rolling and cold rolling. Accordingly, particularly for a general purpose steel species, such as SUS 304, it is the general procedure that the continuously cast slab is subjected to the process of hot rolling and cold rolling without a particular surface treatment on the slab. The surface defect in casting direction with a certain extent existing on the surface of the continuously cast slab appears as a surface flaw extending continuously or intermittently in the rolling direction in the cold rolled steel sheet. Therefore, for providing an austenitic stainless steel cold rolled steel sheet with high quality, it is effective to produce a slab having the surface defect in casting direction that is as small as possible in the stage of continuous casting.

FIG. 1 exemplifies an appearance photograph of a continuously cast slab of an austenitic stainless steel having a surface defect in casting direction with a large extent occurring thereon. The direction in parallel to the long edge of the photograph corresponds to the longitudinal direction (i.e., the casting direction) of the slab, and the direction perpendicular thereto corresponds to the width direction of the slab. A surface defect in casting direction exceeding 27 cm appears at the position pointed by the arrow.

FIG. 2 exemplifies an appearance photograph of a cold rolled steel sheet of an austenitic stainless steel having a surface flaw derived from a surface defect in casting direction of a slab. The direction in parallel to the scale corresponds to the rolling direction. A surface flaw extending in the rolling direction appears at the center portion of the specimen of the cut sheet. The example shown in the photograph is a case where a considerably large flaw is formed. The elemental analysis of the portion having the flaw detects a large amount of the elements contained in the mold powder (such as Na), and thus it is identified that the surface flaw is derived from the surface defect in casting direction of the slab.

FIG. 3 exemplifies a photograph of a cross sectional structure near the surface of a continuously cast slab of an austenitic stainless steel having a surface defect with a relatively large extent in casting direction occurring thereon. The direction in parallel to the long edge of the photograph corresponds to the width direction of the slab, and the direction perpendicular to the long edge and the short edge of the photograph corresponds to the casting direction. Since the surface of the slab around the portion having the crack formed is depressed from the surrounding, it is considered that the distance between the solidification shell and the mold is increased from the surrounding due to some sort of factors in the formation of the initial solidification shell. It is considered that thereby the heat removal by the mold is slowed down from the surrounding to decrease the solidification rate, and the casting proceeds in the state where the thickness of the solidification shell is smaller than the surrounding, resulting in the crack caused by the stress concentration to the portion of the thin solidification shell.

For the cases having a crack of this type formed, the comparison of the metal structure near the surface of the slab between the vicinity of the crack and the normal portion reveals that the dendrite secondary arm spacing is larger in the vicinity of the crack than the normal portion in all the cases, and thus it is confirmed that the solidification rate in the portion having the surface defect in casting direction formed is smaller than the surrounding.

For achieving the homogenization of the initial solidification and the slowing down of cooling, it has been firstly considered to operate with a small difference between the temperature of the liquid metal in the mold and the solidification starting temperature of the steel (i.e., low temperature casting). It has been expected thereby to decrease totally the heat removal amount by the mold. As a result of the experiment, the slowing down of cooling can be achieved by the low temperature casting, but it is significantly difficult to retain the temperature of the liquid metal constantly to a low value over the entire period of casting, and in the case where the temperature of the liquid metal is too high, the effect of the slowing down of cooling disappears, whereas in the case where the temperature of the liquid metal is too low, troubles including clogging of the tundish nozzle occur, resulting in hindrance in the operation. In view of this, the use of in-mold electro-magnetic stirrer (EMS) in addition to the low temperature casting has been considered. This is because the application of the electro-magnetic stirring exerts an effect of making the temperature of the bath surface homogeneous in the long edge direction of the mold. As a result of the experiment, the combination of these measures has achieved the slowing down of cooling and the homogenization of the initial solidification without extremely low temperature casting, and thereby the formation of the surface defect in casting direction can be significantly relieved.

In the case where the casting temperature is not low temperature casting but is an ordinarily employed temperature, the sufficient slowing down of cooling cannot be achieved even though the in-mold electro-magnetic stirrer is applied, and the expected effect has not been obtained for the reduction of the surface defect in casting direction.

In the invention, an austenitic stainless steel having the following chemical composition is targeted:

a chemical composition containing, in terms of percentage by mass, from 0.005 to 0.150% of C, from 0.10 to 3.00% of Si, from 0.10 to 6.50% of Mn, from 1.50 to 22.00% of Ni, from 15.00 to 26.00 of Cr, from 0 to 3.50% of Mo, from 0 to 3.50% of Cu, from 0.005 to 0.250% of N, from 0 to 0.80% of Nb, from 0 to 0.80% of Ti, from 0 to 1.00% of V, from 0 to 0.80% of Zr, from 0 to 1.500% of Al, from 0 to 0.010% of B, and from 0 to 0.060% in total of a rare earth element and Ca, with the balance of Fe and unavoidable impurities, having a value A of 20.0 or less defined by the following expression (4):

$$A=3.647(Cr+Mo+1.5Si+0.5Nb)-2.603(Ni+30C+30N+0.5Mn)-32.377 \quad (4)$$

In the expression (4), the element symbols represent contents of the elements in terms of percentage by mass respectively. The element that is not contained represents 0.

While the value A of the expression (4) is originally used as an index of the proportion (percentage by volume) of a ferrite phase in a solidification structure formed in welding, it has been confirmed that the value is an index that is beneficial for identifying an austenitic steel species having a large effect of relieving the surface defect in casting direction of a continuously cast slab. A stainless steel species having the value that is 20.0 or less tends to undergo the surface defect in casting direction since the crystallization amount of the δ ferrite phase is small in continuous casting, or the austenite single phase is solidified. In the invention, such an austenitic steel species is targeted, and the surface defect in casting direction therein is to be significantly relieved. A steel species having a negative value for the value A can be considered to be a steel species where the austenite phase is solely solidified. The lower limit of the value A may not be particularly set, and in general, a steel having a value of −20.0 or more is effectively applied.

FIG. 4 is a cross sectional view schematically exemplifying a cross sectional structure of a continuous casting apparatus capable of being applied to the invention, cut in the horizontal plane at the surface of the molten steel in the mold. The "surface of the molten steel" means the liquid level of the molten steel. A layer of mold powder is generally formed on the surface of the molten steel. A submerged nozzle 30 is disposed at the center of the region surrounded by two pairs of molds (11A and 11B) and (21A and 22B) facing each other. The submerged nozzle has two discharge ports under the surface of the molten steel, and a molten steel 40 is continuously fed to the interior of the mold from the two discharge ports to form the surface of the molten steel at the prescribed height position in the mold. The mold has an inner wall surface of the mold in a rectangular profile shape cut in the horizontal plane, and in FIG. 4, the "long edge surfaces" constituting the long edges of the rectangular shape are denoted by the symbols 12A and 12B, and the "short edge surfaces" constituting the short edges thereof are denoted by the symbols 22A and 22B. The horizontal direction in parallel to the long edge surface is referred to as a "long edge direction", and the horizontal direction in parallel to the short edge surface is referred to as a "short edge direction". In FIG. 4, the long edge direction is shown by the white outline arrow with the symbol 10, and the short edge direction is shown thereby with the symbol 20. At the level of the surface of the molten steel, the distance between the long edge surfaces 12A and 12B (which is t in FIG. 5 described later) may be, for example, from 150 to 300 mm, and the distance between the short edge surfaces 22A and 22B (which is W in FIG. 5 described later) may be, for example, from 600 to 2,000 mm.

Electro-magnetic stirrer devices 70A and 70B are disposed behind the molds 11A and 11B, and thereby a flowing force in the long edge direction can be applied to the molten steel in a region having a depth providing a thickness of the solidification shell of from 5 to 10 mm formed at least along the surfaces of the long edge surfaces 12A and 12B. The "depth" herein means a depth based on the level of the surface of the molten steel. The surface of the molten steel may fluctuate during the continuous casting, and in the description herein, the average level of the surface of the molten steel is designated as the position of the bath surface. The region having a depth providing a thickness of the solidification shell of from 5 to 10 mm generally exists in a range of a depth of 300 mm or less from the surface of the molten steel while depending on the casting velocity and the heat removal rate from the mold. Accordingly, the electro-magnetic stirrer devices 70A and 70B are disposed at positions capable of applying a flowing force to the molten steel in a depth of approximately 300 mm from the surface of the molten steel.

In FIG. 4, the direction of the molten steel flows in the vicinity of the long edge surfaces formed through the electro-magnetic force of the electro-magnetic stirrer devices 70A and 70B in the region having a depth providing a thickness of the solidification shell of from 5 to 10 mm is shown by the black arrows 60A and 60B respectively. The flow directions by the electro-magnetic stirrer are in such a manner that flows in directions inverse to each other are formed in the long edge direction on both long edge sides. In this case, in the region having a depth providing a thickness of the solidification shell of approximately 10 mm, the horizontal flow of the molten steel in contact with the solidification shell having been formed eddies in the mold. The molten steel near the surface of the molten steel in the mold smoothly flows without stagnation by the eddying flow, thereby enhancing the effect of homogenizing the molten steel temperature in the mold at the time when the molten steel immediately under the surface of the molten steel forming the initial solidification shell is in contact with the mold wall.

FIG. 5 is an illustration showing the "positions at a ¼ position in the long edge direction and a ½ position in the short edge direction" by symbols $P_1$ and $P_2$ in the mold shown in FIG. 4. The average molten steel temperature $T_L$ (° C.) is shown by the average value of the molten steel temperature (° C.) at an average molten steel surface depth of 20 mm at the position $P_1$ and the molten steel temperature (° C.) at an average molten steel surface depth of 20 mm at the position $P_2$.

In the invention, the casting is performed at a temperature as low as possible to satisfy the following expression (1). It is more effective that the casting is performed to satisfy the following expression (1)'.

$$10<\Delta T<50\times F_{EMS}+10 \quad (1)$$

$$10<\Delta T<50\times F_{EMS}+8 \quad (1)'$$

ΔT means the temperature difference between the molten steel temperature in casting and the solidification starting temperature of the molten steel, and specifically is defined by the following expression (2).

$$\Delta T=T_L-T_S \quad (2)$$

As the molten steel temperature in casting, the average molten steel temperature $T_L$ (° C.) is employed. $T_L$ is the average value of the molten steel temperatures (° C.) at an average molten steel surface depth of 20 mm at the positions $P_1$ and $P_2$ shown in FIG. 5. The solidification starting temperature $T_S$ (° C.) of the molten steel can be comprehended by measuring the liquidus line temperature for a steel having the same composition by a laboratory experiment. In the actual operation, ΔT can be controlled based on the data of the solidification temperatures having been comprehended for the every target compositions in advance.

An operation at a low temperature with ΔT of 10° C. or less has a risk of troubles, such as clogging of the tundish nozzle, in the case where an unexpected temperature fluctuation or the like occurs, and thus is difficult to practice industrially. The allowable range of the upper limit of ΔT may vary depending on the stirrer effect of the molten steel in the mold. Basically, with a larger stirring force by the electro-magnetic stirrer, the molten steel temperature near the surface of the molten steel is homogenized to enhance the allowable upper limit of ΔT. Accordingly, the effect of suppressing the surface defect in casting direction of the slab surface cannot be sufficiently provided only by decreasing ΔT without the use of the in-mold electro-magnetic stirrer. However, it has been found that for the precise evaluation of the stirring effect, the influence of the discharge amount of the molten steel fed into the mold cannot be ignored. The index showing the stirring effect is the stirring intensity index $F_{EMS}$ represented by the following expression (3).

$$F_{EMS}=V_{EMS}\times(0.18\times V_C+0.71) \quad (3)$$

wherein $V_{EMS}$ represents an average molten steel flow velocity (m/s) in the long edge direction of the molten steel in contact with the surface of the solidification shell in a depth region providing a solidification shell thickness of from 5 to 10 mm at a center position in the long edge direction imparted by the electro-magnetic stirrer; and $V_C$ represents a casting velocity (m/min). With a larger casting velocity $V_C$, the discharge flow amount from the submerged nozzle is increased, and according thereto, the stirring of the molten steel in the mold is activated. The stirring intensity index $F_{EMS}$ of the expression (3) can be understood as a parameter of the contribution of the electro-magnetic stirrer on the stirring effect that is compensated in consideration of the influence of the discharge amount of the molten steel.

The allowable upper limit of ΔT can be precisely estimated by applying the stirring intensity index $F_{EMS}$ to the expression (1), and more preferably the expression (1)[1]. Specifically, the surface flaw on the cold rolled sheet derived from the surface defect in casting direction can be significantly relieved by performing the continuous casting under the condition where ΔT is smaller than $50\times F_{EMS}+10$ as shown in the expression (1), or more preferably under the condition where ΔT is smaller than $50\times F_{EMS}+8$ as shown in the expression (1)'. With a larger strength of the stirring of the molten steel (i.e., a larger stirrer intensity index $F_{EMS}$), the allowable upper limit of ΔT is enhanced. However, with excessive $F_{EMS}$, the wavy surface of the molten steel becomes severe, and the foreign matters, such as the mold powder particles and the inclusions floating on the surface of the molten steel, tend to be entrained into the solidification shell.

In order that the effect of preventing the surface flaw on the cold rolled steel sheet derived from the surface defect in casting direction is exhibited to a further higher level, the continuous casting condition is preferably controlled to further satisfy also the following expression (5), and further preferably to further satisfy also the following expression (6), in addition to the expression (1) or the expression (1)'.

$$\Delta T\leq 25 \quad (5)$$

$$\Delta T\leq 20 \quad (6)$$

Furthermore, in order that the contamination with foreign matters caused by the wavy surface of the molten steel is effectively prevented, the continuous casting condition is preferably controlled to further satisfy also the following expression (7), and further preferably to further satisfy also the following expression (8).

$$F_{EMS}\leq 0.50 \quad (7)$$

$$F_{EMS}\leq 0.40 \quad (8)$$

FIG. 6 exemplifies a photograph of a metal structure of a continuously cast slab of an austenitic stainless steel according to the invention obtained by a method employing electro-magnetic stirrer, on the cross sectional surface perpendicular to the casting direction. The direction in parallel to the long edge of the photograph is the width direction of the slab, and the direction in parallel to the short edge thereof is the thickness direction of the slab. The photograph shows the view field, in which the lower edge thereof corresponds to a distance of 15 mm from the surface of the slab (i.e., the surface in contact with the mold), and the surface of the slab is on the upper edge side of the photograph.

It has been known that in the case where a liquid metal flows with respect to a mold, the solidification of crystals proceeds with an inclination toward the upstream side of the flow, and the inclination angle of the crystal growth is increased with the increase of the flow velocity. In the example shown in FIG. 6, the growth direction of the dendrite primary arm is inclined right. Accordingly, it is understood therefrom that the molten steel in contact with the solidification shell flows from right to left in the photograph. The relationship between the flow velocity of the molten steel in contact with the solidification shell and the inclination angle of the crystal growth can be known, for example, by a solidification experiment using a rotating rod-shaped heat-removing body. The flow velocity of the molten steel in contact with the solidification shell in the continuous casting can be estimated based on the data collected by the laboratory experiments in advance. The average flow velocity $V_{EMS}$ in the long edge direction of the molten steel in contact with the surface of the solidification shell in a depth region providing a solidification shell thickness of from 5 to 10 mm can be comprehended by measuring the average inclination angle of the dendrite primary arm at a distance of from 5 to 10 mm from the surface by the cross-sectional photograph. In the example shown in FIG. 6, $V_{EMS}$ is estimated as approximately 0.3 m/s. It is practical in an ordinary continuous casting apparatus that $V_{EMS}$ is controlled, for example, to a range of from 0.1 to 0.6 mm/s. $V_{EMS}$ may also be managed to from 0.2 to 0.4 mm/s.

In the actual operation, the molten steel flow velocity $V_{EMS}$ can be controlled by an electric current value applied to the electro-magnetic stirrer device (which may be hereinafter referred to as an "electro-magnetic stirrer current"). In the continuous casting apparatus equipped with the electro-magnetic stirrer device, the "relationship between the electro-magnetic stirrer current and the molten steel flow velocities at positions in the mold" has been accumulated as data in advance through the computer simulations, the experiments for actual measurements of the molten steel flow velocities, and the structure observations described above for the slabs collected in the many actual operations. In the actual operation, $V_{EMS}$ may be controlled to the prescribed value with the electro-magnetic stirrer current based on the accumulated data.

FIG. 7 exemplifies a photograph of a metal structure of a continuously cast slab of an austenitic stainless steel obtained by a method employing no electro-magnetic stirrer, on the cross sectional surface perpendicular to the casting direction. The observation position of the specimen is the same as in FIG. 6. In this case, no inclination in one direction is found in the growth direction of the dendrite. Accordingly, it is understood that the portion providing a thickness of the solidification shell of from 5 to 10 mm of this cast piece is solidified in a state where the molten steel does not flow in the long edge direction.

EXAMPLES

The austenitic stainless steels having the chemical compositions shown in Table 1 were cast with a continuous casting apparatus to produce cast pieces (slabs).

TABLE 1

| | Chemical composition (% by mass) | | | | | | | | | | | | |
|---|---|---|---|---|---|---|---|---|---|---|---|---|---|
| No. | C | Si | Mn | Ni | Cr | Mo | Cu | Nb | N | Ti | Al | Others | Value A |
| 1 | 0.058 | 0.51 | 0.95 | 8.08 | 18.24 | 0.24 | 0.32 | 0.02 | 0.026 | 0.00 | 0.001 | — | 9.0 |
| 2 | 0.056 | 0.49 | 0.81 | 8.08 | 18.51 | 0.21 | 0.25 | 0.02 | 0.022 | 0.00 | 0.001 | — | 10.5 |
| 3 | 0.016 | 0.59 | 1.74 | 14.51 | 18.49 | 3.29 | 0.29 | 0.01 | 0.059 | 0.00 | 0.003 | — | 4.4 |
| 4 | 0.058 | 0.58 | 1.49 | 11.02 | 18.15 | 0.21 | 0.32 | 0.79 | 0.026 | 0.00 | 0.001 | — | 2.0 |
| 5 | 0.091 | 0.57 | 0.93 | 7.00 | 16.95 | 0.26 | 0.25 | 0.03 | 0.033 | 0.00 | 0.003 | — | 4.4 |
| 6 | 0.064 | 0.51 | 0.95 | 8.37 | 18.30 | 0.30 | 0.43 | 0.03 | 0.028 | 0.01 | 0.002 | — | 8.1 |
| 7 | 0.068 | 0.50 | 1.06 | 8.32 | 18.51 | 0.25 | 0.35 | 0.03 | 0.030 | 0.01 | 0.003 | — | 8.2 |
| 8 | 0.018 | 0.74 | 1.18 | 12.53 | 18.61 | 2.39 | 0.37 | 0.02 | 0.012 | 0.00 | 0.008 | — | 11.8 |
| 9 | 0.020 | 0.68 | 1.34 | 13.30 | 17.53 | 2.29 | 0.38 | 0.02 | 0.012 | 0.00 | 0.006 | — | 4.8 |
| 10 | 0.017 | 0.72 | 1.11 | 13.01 | 17.79 | 2.10 | 0.29 | 0.02 | 0.013 | 0.00 | 0.006 | — | 6.5 |
| 11 | 0.039 | 1.46 | 0.27 | 6.87 | 13.79 | 0.77 | 0.66 | 0.00 | 0.008 | 0.33 | 0.035 | — | 6.8 |
| 12 | 0.058 | 0.46 | 1.02 | 8.81 | 18.97 | 0.26 | 0.35 | 0.02 | 0.026 | 0.00 | 0.001 | — | 9.5 |
| 13 | 0.017 | 0.56 | 1.64 | 13.79 | 19.07 | 3.39 | 0.32 | 0.01 | 0.061 | 0.00 | 0.003 | — | 8.5 |
| 14 | 0.054 | 0.62 | 1.42 | 10.62 | 19.95 | 0.20 | 0.33 | 0.80 | 0.027 | 0.00 | 0.001 | — | 10.2 |
| 15 | 0.041 | 1.41 | 0.28 | 7.24 | 14.00 | 0.78 | 0.60 | 0.00 | 0.007 | 0.33 | 0.037 | — | 6.2 |
| 16 | 0.052 | 0.70 | 1.11 | 18.73 | 27.36 | 0.02 | 0.07 | 0.01 | 0.017 | 0.00 | 0.001 | — | 15.8 |
| 17 | 0.047 | 0.74 | 1.08 | 19.19 | 25.04 | 0.03 | 0.06 | 0.01 | 0.018 | 0.00 | 0.001 | — | 6.7 |
| 18 | 0.086 | 2.78 | 0.22 | 8.34 | 13.70 | 2.21 | 0.26 | 0.00 | 0.069 | 0.00 | 0.000 | — | 6.8 |
| 19 | 0.079 | 0.58 | 6.05 | 2.06 | 17.23 | 0.18 | 2.18 | 0.02 | 0.175 | 0.00 | 0.001 | — | 1.3 |
| 20 | 0.131 | 0.44 | 1.72 | 6.26 | 16.62 | 0.26 | 0.35 | 0.01 | 0.062 | 0.00 | 0.001 | — | −1.9 |
| 21 | 0.059 | 1.73 | 0.62 | 11.01 | 20.31 | 0.21 | 0.16 | 0.12 | 0.151 | 0.00 | 0.044 | Ca: 0.002<br>REM: 0.043 | 6.3 |
| 22 | 0.087 | 2.79 | 0.21 | 8.02 | 13.60 | 2.22 | 0.25 | 0.00 | 0.064 | 0.00 | 0.000 | — | 7.6 |
| 23 | 0.081 | 0.59 | 6.51 | 2.01 | 16.97 | 0.18 | 2.19 | 0.02 | 0.169 | 0.00 | 0.001 | — | 0.1 |
| 24 | 0.127 | 0.47 | 1.64 | 6.50 | 18.14 | 0.28 | 0.36 | 0.01 | 0.061 | 0.00 | 0.001 | — | 3.7 |
| 25 | 0.072 | 0.49 | 0.76 | 7.21 | 16.57 | 0.11 | 0.19 | 0.02 | 0.031 | 0.00 | 1.180 | Ca: 0.001 | 3.4 |
| 26 | 0.029 | 0.58 | 1.01 | 9.08 | 17.34 | 0.15 | 0.33 | 0.02 | 0.009 | 0.48 | 0.023 | Ca: 0.001 | 6.7 |
| 27 | 0.017 | 0.64 | 1.12 | 12.08 | 17.16 | 2.11 | 0.32 | 0.01 | 0.011 | 0.00 | 0.004 | — | 6.4 |
| 28 | 0.058 | 0.48 | 1.02 | 8.05 | 18.21 | 0.28 | 0.33 | 0.02 | 0.028 | 0.00 | 0.001 | V: 0.09 | 8.7 |
| 29 | 0.017 | 0.33 | 1.73 | 8.04 | 17.04 | 0.22 | 3.19 | 0.01 | 0.012 | 0.01 | 0.003 | — | 6.9 |
| 30 | 0.059 | 0.59 | 1.10 | 8.06 | 18.34 | 0.26 | 0.35 | 0.01 | 0.024 | 0.00 | 0.002 | Zr: 0.31 | 9.8 |
| 31 | 0.041 | 0.69 | 0.99 | 19.15 | 25.12 | 0.11 | 0.10 | 0.01 | 0.019 | 0.00 | 0.002 | B: 0.004<br>Ca: 0.001 | 7.6 |
| 32 | 0.064 | 1.67 | 0.65 | 11.27 | 20.79 | 0.23 | 0.15 | 0.13 | 0.146 | 0.00 | 0.044 | Ca: 0.002 | 7.1 |
| 33 | 0.068 | 0.51 | 1.15 | 8.02 | 18.87 | 0.30 | 0.48 | 0.03 | 0.032 | 0.01 | 0.004 | — | 10.2 |

TABLE 1-continued

| | Chemical composition (% by mass) | | | | | | | | | | | | |
|---|---|---|---|---|---|---|---|---|---|---|---|---|---|
| No. | C | Si | Mn | Ni | Cr | Mo | Cu | Nb | N | Ti | Al | Others | Value A |
| 34 | 0.071 | 0.47 | 0.75 | 7.28 | 17.87 | 0.12 | 0.19 | 0.02 | 0.033 | 0.00 | 1.158 | Ca: 0.001 | 7.8 |
| 35 | 0.030 | 0.56 | 1.10 | 9.38 | 18.45 | 0.14 | 0.31 | 0.02 | 0.010 | 0.49 | 0.024 | Ca: 0.001 | 9.5 |
| 36 | 0.057 | 0.47 | 0.95 | 8.05 | 18.13 | 0.24 | 0.31 | 0.02 | 0.024 | 0.00 | 0.001 | — | 8.7 |

The continuous casting mold was an ordinary water-cooling copper alloy mold having a contact surface to a molten metal constituted by a copper alloy. The size of the mold for the continuous casting at the level of the surface of the molten steel was set to 200 mm for the short edge length and a range of from 700 to 1,650 mm for the long edge length. The dimension at the lower end of the mold was slightly smaller than the aforementioned size in consideration of the solidification contraction. A submerged nozzle having two discharge ports on both sides in the long edge direction was disposed at the center position in the long edge direction and the short edge direction. The submerged nozzle had an outer diameter of 105 mm. The two discharge ports were disposed symmetrically with respect to a plane passing through the center of the nozzle and in parallel to the short edge surface. Electro-magnetic stirrer devices were disposed on the back sides of the molds on the long edges facing each other, and electro-magnetic stirring was performed to impart a flowing force in the long edge direction to the molten steel in the depth position in the vicinity of the surface of the molten steel to the depth position of approximately 200 mm in the mold. As shown in FIG. 1, the flow directions on the both long edge edges facing each other were made inverse to each other. The average flow velocity $V_{EMS}$ in the long edge direction of the molten steel in contact with the surface of the solidification shell in the depth region providing a thickness of the solidification shell of from 5 to 10 mm was controlled by adjusting the electro-magnetic stirrer current based on the accumulated data of the "relationship between the electro-magnetic stirrer current and the molten steel flow velocities at positions in the mold" having been obtained in advance for the continuous casting apparatus. The molten steel temperatures (° C.) at an average molten steel surface depth of 20 mm at the two positions $P_1$ and $P_2$ shown in FIG. 5 were measured with a thermocouple, and the average value of the two positions was employed as the average molten steel temperature $T_L$ (° C.).

Table 2 shows the casting conditions of the examples. ΔT is the difference between the average molten steel temperature $T_L$ (° C.) and the solidification starting temperature $T_S$ (° C.) according to the expression (2). The solidification starting temperatures $T_S$ (° C.) are shown in Table 1. In the column of "Evaluation by expression (1)", the case that satisfies the requirement of the expression (1) is shown by "pass", and the case that does not satisfy the requirement is shown by "fail".

Plural continuously cast slabs each having a length of approximately 8 m were produced for each of the examples numbers in Table 2 according to the continuous casting condition therefor. One of the slabs was selected as a representative slab of the example number. The surface of one side of the representative slab was visually observed to investigate the presence of a surface defect in casting direction involving a surface crack. The case where the presence of a surface crack is apparently confirmed visually is shown by "Surface crack of slab: yes" in Table 2.

The representative slab of each of the example numbers was subjected to the ordinary hot rolling process and cold rolling process to provide a cold rolled coil having a sheet thickness of from 0.6 to 2.0 mm. The surface of the slab was not treated with a grinder. The resulting cold rolled coil was subjected to the line equipped with a laser surface inspection device, and one surface of the coil was inspected over the entire length thereof according to a fixed inspection standard to research the presence of a surface flaw. In the case where a surface flaw was detected in a region obtained by dividing the entire length of the coil by 1 m in the longitudinal direction (hereinafter referred to as a "segment"), the segment was designated as a "flawed segment". The proportion of the number of the "flawed segments" in the total number of the segments over the entire length of the coil (hereinafter referred to as a "defect occurrence rate") was obtained, and the case having a defect occurrence rate exceeding 3% was evaluated as "poor" (poor surface property), whereas the case having a "defect occurrence rate" of 3% or less was evaluated as "good" (good surface property). The results are shown in the column "Evaluation of surface flaw of cold rolled coil" in Table 2. The inspection standard is a fairly severe one, and flaws other than the flaw derived from the surface defect in casting direction of the continuously cast slab are also detected. In general, a cold rolled coil having a defect occurrence rate exceeding 3% can be applied to most purposes, but in some cases, cannot be applied to purposes where the surface property is important. On the other hand, a cold rolled coil having a defect occurrence rate of 3% or less can be evaluated as having an extremely good surface property, and the restriction in purpose due to flaws thereof is significantly small.

TABLE 2

| | Continuous casting condition | | | | | | | | Evaluation of |
|---|---|---|---|---|---|---|---|---|---|
| Example No. | TS (° C.) | ΔT (° C.) | $V_C$ (m/min) | $V_{EMS}$ (m/s) | $F_{EMS}$ *1 | $50F_{EMS}$ + 10 | Evaluation by expression (1) | Surface crack of slab | surface flaw of cold rolled coil |
| 1 | 1449 | 25 | 0.50 | 0.40 | 0.32 | 26.0 | pass | — | good |
| 2 | 1449 | 28 | 0.80 | 0.40 | 0.34 | 27.1 | fail | yes | poor |
| 3 | 1420 | 25 | 1.00 | 0.40 | 0.36 | 27.8 | pass | — | good |
| 4 | 1445 | 24 | 1.40 | 0.40 | 0.38 | 29.2 | pass | — | good |
| 5 | 1460 | 26 | 0.50 | 0.20 | 0.16 | 18.0 | fail | yes | poor |
| 6 | 1449 | 25 | 0.80 | 0.28 | 0.24 | 22.0 | fail | — | good |
| 7 | 1449 | 24 | 1.00 | 0.28 | 0.25 | 22.5 | fail | yes | poor |

TABLE 2-continued

| Example No. | TS (° C.) | Continuous casting condition ΔT (° C.) | $V_C$ (m/min) | $V_{EMS}$ (m/s) | $F_{EMS}$ *1 | $50F_{EMS}$ + 10 | Evaluation by expression (1) | Surface crack of slab | Evaluation of surface flaw of cold rolled coil |
|---|---|---|---|---|---|---|---|---|---|
| 8 | 1428 | 25 | 1.40 | 0.00 | 0.00 | 10.0 | fail | yes | poor |
| 9 | 1428 | 29 | 0.50 | 0.30 | 0.24 | 22.0 | fail | yes | poor |
| 10 | 1428 | 31 | 0.80 | 0.40 | 0.34 | 27.1 | fail | yes | poor |
| 11 | 1455 | 30 | 1.00 | 0.50 | 0.45 | 32.3 | pass | — | good |
| 12 | 1449 | 31 | 1.40 | 0.40 | 0.38 | 29.2 | fail | yes | poor |
| 13 | 1420 | 31 | 0.50 | 0.28 | 0.22 | 21.2 | fail | yes | poor |
| 14 | 1445 | 30 | 0.80 | 0.00 | 0.00 | 10.0 | fail | yes | poor |
| 15 | 1455 | 28 | 1.00 | 0.28 | 0.25 | 22.5 | fail | — | good |
| 16 | 1416 | 30 | 1.40 | 0.28 | 0.27 | 23.5 | fail | yes | poor |
| 17 | 1416 | 21 | 0.50 | 0.40 | 0.32 | 26.0 | pass | — | good |
| 18 | 1435 | 20 | 0.80 | 0.40 | 0.34 | 27.1 | pass | — | good |
| 19 | 1437 | 19 | 1.00 | 0.50 | 0.45 | 32.3 | pass | — | good |
| 20 | 1460 | 20 | 1.40 | 0.40 | 0.38 | 29.2 | pass | — | good |
| 21 | 1425 | 18 | 0.50 | 0.28 | 0.22 | 21.2 | pass | — | good |
| 22 | 1435 | 20 | 0.80 | 0.00 | 0.00 | 10.0 | fail | yes | poor |
| 23 | 1437 | 19 | 1.00 | 0.10 | 0.09 | 14.5 | fail | yes | poor |
| 24 | 1460 | 20 | 1.40 | 0.00 | 0.00 | 10.0 | fail | yes | poor |
| 25 | 1462 | 16 | 0.50 | 0.40 | 0.32 | 26.0 | pass | — | good |
| 26 | 1453 | 15 | 0.80 | 0.40 | 0.34 | 27.1 | pass | — | good |
| 27 | 1428 | 17 | 1.00 | 0.30 | 0.27 | 23.4 | pass | — | good |
| 28 | 1449 | 15 | 1.40 | 0.40 | 0.38 | 29.2 | pass | — | good |
| 29 | 1451 | 15 | 0.50 | 0.28 | 0.22 | 21.2 | pass | — | good |
| 30 | 1449 | 16 | 0.80 | 0.28 | 0.24 | 22.0 | pass | — | good |
| 31 | 1416 | 15 | 1.00 | 0.20 | 0.18 | 18.9 | pass | — | good |
| 32 | 1425 | 15 | 1.40 | 0.00 | 0.00 | 10.0 | fail | yes | poor |
| 33 | 1449 | 20 | 1.35 | 0.30 | 0.29 | 24.3 | pass | — | good |
| 34 | 1462 | 16 | 1.10 | 0.00 | 0.00 | 10.0 | fail | — | good |
| 35 | 1453 | 25 | 1.20 | 0.30 | 0.28 | 23.9 | fail | — | good |
| 36 | 1428 | 19 | 1.10 | 0.00 | 0.00 | 10.0 | fail | — | good |

*1: $V_{EMS}$ $(0.18V_C + 0.71)$

FIG. 8 shows a graph plotting the relationship between ΔT and $F_{EMS}$ in Table 2. In the plots, the circle mark and the cross mark correspond to the good evaluation and the poor evaluation respectively in the "Evaluation of surface flaw of cold rolled coil" in Table 2. In FIG. 8, the borderline of the allowable upper limit of ΔT ($\Delta T=50\times F_{EMS}+10$) of the expression (1) is shown by the broken line. There are some examples having less surface flaw of the cold rolled coil with the good evaluation even in the case where ΔT is larger than the line. However, for stably achieving the good surface property with the good evaluation, it is significantly effective to employ a condition providing ΔT under the line.

REFERENCE SIGN LIST

10 long edge direction
11A, 11B mold
12A, 12B long edge surface
20 short edge direction
21A, 21B mold
22A, 22B short edge surface
30 submerged nozzle
40 molten steel
42 solidification shell
60A, 60B flow direction of molten steel by electro-magnetic stirrer
70A, 70B electro-magnetic stirrer device

The invention claimed is:

1. A method for producing an austenitic stainless steel slab, using a mold having a rectangular profile shape of an inner surface of the mold cut in a horizontal plane, two inner wall surfaces of the mold constituting long edges of the rectangular shape each are referred to as a "long edge surface", two inner wall surfaces of the mold constituting short edges thereof each are referred to as a "short edge surface", a horizontal direction in parallel to the long edge surface is referred to as a "long edge direction", and a horizontal direction in parallel to the short edge surface is referred to as a "short edge direction", comprising: discharging a molten steel of an austenitic stainless steel having a chemical composition containing, in terms of percentage by mass, from 0.005 to 0.150% of C, from 0.10 to 3.00% of Si, from 0.10 to 6.50% of Mn, from 1.50 to 22.00% of Ni, from 15.00 to 26.00 of Cr, from 0 to 3.50% of Mo, from 0 to 3.50% of Cu, from 0.005 to 0.250% of N, from 0 to 0.80% of Nb, from 0 to 0.80% of Ti, from 0 to 1.00% of V, from 0 to 0.80% of Zr, from 0 to 1.500% of Al, from 0 to 0.010% of B, and from 0 to 0.060% in total of a rare earth element and Ca, with the balance of Fe and unavoidable impurities, having a value A of 20.0 or less defined by the following expression (4), from a submerged nozzle having two discharge ports disposed at a center in the long edge direction and the short edge direction in the mold; and applying electric power to the molten steel in a vicinity of a solidification shell in a depth region providing a solidification shell thickness of from 5 to 10 mm at least at a center position in the long edge direction, so as to cause flows in directions inverse to each other in the long edge direction on both long edge sides, thereby performing electro-magnetic stirring (EMS) to control a continuous casting condition satisfying the following expression (1):

$$10<\Delta T<50\times F_{EMS}+10 \quad (1)$$

wherein ΔT and $F_{EMS}$ are represented by the following expressions (2) and (3) respectively:

$$\Delta T = T_L - T_S \quad (2)$$

$$F_{EMS} = V_{EMS} \times (0.18 \times V_C + 0.71) \quad (3)$$

wherein $T_L$ represents an average molten steel temperature (° C.) at an average molten steel surface depth of 20 mm at a position of a ¼ position in the long edge direction and a ½ position in the short edge direction; $T_S$ represents a solidification starting temperature (° C.) of the molten steel; $F_{EMS}$ represents a stirring intensity index; $V_{EMS}$ represents an average molten steel flow velocity (m/s) in the long edge direction imparted by the electro-magnetic stirring in a depth region providing a solidification shell thickness of from 5 to 10 mm at a center position in the long edge direction; and $V_C$ represents a casting velocity (m/min) corresponding to a progress velocity of the cast slab in a longitudinal direction:

$$A = 3.647(\mathrm{Cr}+\mathrm{Mo}+1.5\mathrm{Si}+0.5\mathrm{Nb}) - 2.603(\mathrm{Ni}+30\mathrm{C}+30\mathrm{N}+0.5\mathrm{Mn}) - 32.377 \quad (4)$$

wherein the element symbols in the expression (4) represent contents of the elements in terms of percentage by mass respectively.

2. The method for producing an austenitic stainless steel slab according to claim 1, wherein the continuous casting condition is controlled to further satisfy also the following expression (5):

$$\Delta T \leq 25 \quad (5).$$

3. The method for producing an austenitic stainless steel slab according to claim 1, wherein the continuous casting condition is controlled to further satisfy also the following expression (6):

$$\Delta T \leq 20 \quad (6).$$

4. The method for producing an austenitic stainless steel slab according to claim 1, wherein the continuous casting condition is controlled to further satisfy also the following expression (7):

$$F_{EMS} \leq 0.50 \quad (7).$$

5. The method for producing an austenitic stainless steel slab according to claim 1, wherein the continuous casting condition is controlled to further satisfy also the following expression (8):

$$F_{EMS} \leq 0.40 \quad (8).$$

* * * * *